US006588218B1

(12) United States Patent
Hutchison

(10) Patent No.: US 6,588,218 B1
(45) **Date of Patent: *Jul. 8, 2003**

(54) CRYOGENIC TEMPERING PROCESS FOR DYNAMOELECTRIC DEVICES

(75) Inventor: David C. Hutchison, Rogersville, MO (US)

(73) Assignee: CryoPro, L.L.C., Springfield, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/057,808

(22) Filed: Jan. 25, 2002

Related U.S. Application Data

(63) Continuation-in-part of application No. 09/848,961, filed on May 4, 2001, which is a continuation-in-part of application No. 09/662,581, filed on Sep. 14, 2000, now Pat. No. 6,314,743.

(60) Provisional application No. 60/202,286, filed on May 5, 2000, provisional application No. 60/153,966, filed on Sep. 15, 1999, and provisional application No. 60/264,392, filed on Jan. 26, 2001.

(51) Int. Cl.[7] ..... F25D 25/00; F25D 17/02; C21D 6/04; C22F 1/08

(52) U.S. Cl. ..... 62/62; 62/64; 148/577; 148/679

(58) Field of Search ..... 62/51.1, 62, 64; 148/577–578, 660, 662, 664, 679

(56) References Cited

U.S. PATENT DOCUMENTS

| | | | | |
|---|---|---|---|---|
| 4,482,005 A | * | 11/1984 | Voorhees | 148/578 |
| 4,739,622 A | | 4/1988 | Smith | 62/78 |
| 5,044,422 A | | 9/1991 | Lenker | 165/2 |
| 5,174,122 A | | 12/1992 | Levine | 62/50.2 |
| 5,259,200 A | | 11/1993 | Kamody | 62/64 |
| 5,263,886 A | | 11/1993 | Workman | 445/7 |
| 5,442,929 A | * | 8/1995 | Gillin | 200/268 |
| 5,447,035 A | | 9/1995 | Workman et al. | 62/62 |
| 5,865,913 A | * | 2/1999 | Paulin et al. | 148/577 |
| 6,056,857 A | | 5/2000 | Hunt et al. | 204/192.15 |
| 6,141,974 A | * | 11/2000 | Waldmann et al. | 165/206 |
| 6,164,079 A | | 12/2000 | Waldmann et al. | 62/62 |
| 6,314,743 B1 | * | 11/2001 | Hutchison | 148/577 |

* cited by examiner

*Primary Examiner*—William C. Doerrler
(74) *Attorney, Agent, or Firm*—Jonathan A. Bay

(57) ABSTRACT

A process for treating a conductor winding component of a dynamoelectric device incorporates a cryogenic cycle having a ramp down phase during which the conductor winding component is ramped down from at least about −100° F. in a dry cryogenic environment to about −300° F. over several hours, preferably greater than five (5) hours and including seven (7) hours or more, followed by a cryogenic hold phase during which the conductor winding component is held at about −300° F. over an additional several hours, preferably greater than twenty-four (24) hours and including thirty-six (36) hours or more, followed by a cryogenic ramp up phase during which the conductor winding component is ramped up to about −200° F. over another several hours, preferably greater than twelve (12) hours and including eighteen (18) hours or more.

18 Claims, 7 Drawing Sheets

COMPARISON OF AC MOTOR BEFORE & AFTER CRYOGENIC TEMPERING

| RPM | TORQUE BEFORE | TORQUE AFTER | % CHANGE | HP BEFORE | HP AFTER | % CHANGE | AMPS BEFORE | AMPS AFTER | CHANGE | Efficiency BEFORE | Efficiency AFTER | CHANGE |
|---|---|---|---|---|---|---|---|---|---|---|---|---|
| 1761 | 0 | 0.1 | * | 0 | 0.0001 | * | 0 | 0.58 | * | 0 | 0.26 | * |
| 1750 | 0.2 | 1.3 | 550.00% | 0.0003 | 0.0023 | 666.67% | 0.6 | 0.58 | -3.33% | 0.51 | 5.68 | 1013.73% |
| 1700 | 3.5 | 6.2 | 77.14% | 0.0059 | 0.0105 | 77.97% | 0.6 | 0.59 | -1.67% | 11.09 | 19.49 | 75.74% |
| 1650 | 7 | 9.8 | 40.00% | 0.0114 | 0.0161 | 41.23% | 0.63 | 0.62 | -1.59% | 21.24 | 30.03 | 41.38% |
| 1600 | 9.5 | 12.5 | 31.58% | 0.0151 | 0.0198 | 31.13% | 0.64 | 0.64 | 0.00% | 28.09 | 29.56 | 5.23% |
| 1550 | 11.2 | 14.1 | 25.89% | 0.0172 | 0.0217 | 26.16% | 0.67 | 0.68 | 1.49% | 25.6 | 32.39 | 26.52% |
| 1500 | 12.4 | 15 | 20.97% | 0.0184 | 0.0224 | 21.74% | 0.7 | 0.71 | 1.43% | 27.48 | 33.39 | 21.51% |
| 1450 | 13.1 | 15.5 | 18.32% | 0.0188 | 0.0223 | 18.62% | 0.72 | 0.72 | 0.00% | 28.12 | 31.96 | 13.66% |
| * | 13.3 | 15.6 | 17.29% | 0.0191 | 0.0219 | 14.66% | 0.73 | 0.75 | 2.74% | 28.45 | 27.26 | -4.18% |
| 1400 | 13.2 | 15.6 | 18.18% | 0.0184 | 0.0217 | 17.93% | 0.75 | 0.76 | 1.33% | 22.83 | 26.95 | 18.05% |
| 1350 | 13.2 | 15.4 | 16.67% | 0.0177 | 0.0206 | 16.38% | 0.76 | 0.77 | 1.32% | 22.05 | 25.61 | 16.15% |
| 1300 | 13.1 | 14.9 | 13.74% | 0.0169 | 0.0193 | 14.20% | 0.79 | 0.8 | 1.27% | 21.07 | 23.95 | 13.67% |
| 1250 | 12.4 | 14.4 | 16.13% | 0.0154 | 0.0178 | 15.58% | 0.81 | 0.81 | 0.00% | 19.11 | 22.19 | 16.12% |
| 1200 | 12.2 | 13.7 | 12.30% | 0.0145 | 0.0163 | 12.41% | 0.83 | 0.83 | 0.00% | 18.07 | 20.23 | 11.95% |
| 1000 | 9.4 | 10.4 | 10.64% | 0.0093 | 0.0103 | 10.75% | 0.86 | 0.88 | 2.33% | 11.62 | 12.83 | 10.41% |
| 800 | 6.7 | 7.4 | 10.45% | 0.0053 | 0.0059 | 11.32% | 0.88 | 0.9 | 2.27% | 6.64 | 7.29 | 9.79% |
| 600 | 6.5 | 7.4 | 13.85% | 0.0039 | 0.0044 | 12.82% | 0.9 | 0.92 | 2.22% | 4.79 | 4.74 | -1.04% |
| 400 | 6.8 | 8.2 | 20.59% | 0.0027 | 0.0033 | 22.22% | 0.91 | 0.93 | 2.20% | 3.38 | 3.47 | 2.66% |
| 200 | 5.8 | 7.1 | 22.41% | 0.0011 | 0.0014 | 27.27% | 0.92 | 0.94 | 2.17% | 1.42 | 1.51 | 6.34% |
| 0 | 6.2 | 6.1 | -1.61% | 0 | 0 | * | 0.92 | 0.94 | 2.17% | 0 | 0 | * |

Fig. 3

CRYOGENIC TEMPERING PROCESS FOR DYNAMOELECTRIC DEVICES

CROSS-REFERENCE TO RELATED APPLICATION(S)

This application is a continuation-in-part of U.S. patent application Ser. No. 09/848,961, filed May 4, 2001, which claims the benefit of U.S. Provisional Application No. 60/202,286, filed May 5, 2000, and being incorporated fully herein by this reference; and which also is a continuation-in-part of U.S. patent application Ser. No. 09/662,581, filed Sep. 14, 2000, now U.S. Pat. No. 6,314,743 (B1), which claims the benefit of U.S. Provisional Application No. 60/153,966, filed Sep. 15, 1999.

This application as well claims the benefit of U.S. Provisional Application No. 60/264,392, filed Jan. 26, 2001.

BACKGROUND AND SUMMARY OF THE INVENTION

The invention generally relates to dynamoelectric devices (electric motors and generators) more particularly, to a cryogenic tempering process for increasing the efficiency and performance of both electric motors and generators. There are many types of dynamoelectric devices that can benefit by this cryogenic tempering process. Some of them are alternating current (AC), direct current (DC), brushless direct current (BLDC), split phase, shaded pole and brush type motors. By utilizing this cryogenic tempering process on a standard dynamoelectric device, the unit will be more efficient, run cooler and lower operation costs.

In the case of the electric motor, it will consume less electricity and produce more power than before and the generator will produce more electricity for the same amount of drive input. This efficiency increase produces several benefits. The first being that the national demand for electricity could be drastically reduced thus reducing the consumption rate of our natural resources and lessening our dependence on foreign energy. Another benefit would be that motors could be made smaller for the same power output. So less raw material would be consumed and applications where size or weight were a concern. It is believed that all types of dynamoelectric devices will respond to this cryogenic tempering process. Everything from small fractional horse power (F.H.P.) motors to large 25–10,000 horse power (H.P.) motors will see similar results. The cryogenic tempering process can be done on both completed motors as well as applied to new motor components during the production process before final assembly. The cost of the cryogenic process will be minimal compared to the energy savings over the life of the unit.

Tests show that a motor's efficiency will be increased by approximately twenty five percent (25%) at the motors rated operating speed and torque. The cryogenic tempering process benefits the copper winding in the motor/generator most directly. It is believed that the cryogenic tempering process relieves the stress in the copper winding left by the winding D process around (eg.) the iron lamination. The winding process induces stress in the copper winding and reduces the efficiency of the dynamoelectric device. By utilizing this cryogenic tempering process on the wound copper component, it will stress relieve the copper after the winding process. Revealing evidence shows that cryogenic tempering process on the copper winding has the capability to handle an increase in current. The ability to handle the increased current also means that the dynamoelectric device will run cooler for the same speed and load. Since resistance rises in copper as the temperature rises, the cooler the motor runs the more efficient the motor will be. So with the combination of running cooler, capable of moving electron flow more efficiently and the unit producing more performance, these three factors combine to equal a increase in efficiency of twenty five percent (25%) in the operation of the dynamoelectric device.

Tests were done to find which single segment of the motors construction responded to the cryogenic tempering process and was responsible for the increase in efficiency. The first test took a production fractional H.P. motor and testing for speed and torque and energy consumption. This test gave the base line for comparison. The same motor was then cryogenically tempered. The motor was then tested under the same test as before. When the before and after tests are compared, a 26.52% increase in efficiency was achieved. The motor was 25.6% efficient before the test and 32.39% efficient after the cryogenic tempering process. For comparison, untreated motors were tested and the findings recorded. Then some electrical components (but not rotor or stator) were treated by the cryogenic tempering process, and then these motors were re-tested and the findings recorded. After that other components like rotor and stator were treated by the cryogenic tempering process, which was followed by re-testing these motors again and the recording the findings again. The tests were indifferent until the stator with the copper windings were cryogenically tempered after being wound. The copper winding wire was treated before winding with no improvement in performance. So the tests show that the efficiency benefit to the motor is directly related to the motor's copper winding being cryogenically tempered after being wound.

Because the cryogenic tempering process is permanent and the copper winding is stationary once wound, the copper retains the benefits of the cryogenic tempering process for the life of the dynamoelectric device.

In U.S. Pat. No. 5,442,929—Gillin, a cryogenic treatment of electrical contacts is disclosed in which, the contacts-under-treatment are enclosed within a sheath, such as a layer of aluminum foil, "to cover the contacting surface and protect the contact from convection currents or other sources of thermal irregularities and to provide a uniform micro climate about the contact." U.S. Pat. No. 5,442,929.

U.S. Pat. No. 5,174,122—Levine, lists compound ways which cryogenic processing can go awry and diminish the wear ability of a part rather than extend it.

Some of the problems encountered with the prior apparatus described above arise as follows:—(1) delivery of liquid nitrogen to the bottom of the chamber below the payload platform often splashes or splatters the liquid on the payload parts causing extreme thermal shock to the parts that are still relatively warm, (2) the coldest gas in the chamber is just above the liquid and the gas does not flow upward (rise) to the payload parts-the cold gas does not reach the parts until just about all of the gas in the chamber is cold and the coldest gas will always be below the payload parts; (3) presoaking the part partially submersed in the liquid nitrogen causes the part to chill unevenly, as the portion of the part that is submersed chills much faster than the portion that is not submersed; and (4) any submersion of the part in the liquid nitrogen results in boiling heat transfer from the part at an excessive rate that does not allow all portions of the part to cool evenly. U.S. Pat. No. 5,174,122.

Certain formats of cryogenic treatment are known for extending the wear-ability of various steel alloy articles. For instance, the U.S. Patent to Nu-Bit, Inc., Pat. No. 5,259,200—Kamody discloses particular format of a cryogenic treatment for drill bits:—large drill bits, according to Kamody, the state of the prior art at the time of his invention practiced by the following convention:

> As is apparent from the above description, the time period necessary to complete each step in the cycle of the treatment process generally is a minimum of about an hour per cross-section inch of the article being treated. Thus, for example, treatment of a steel article having a one inch cross-section in the minimum dimension would require a minimum of four hours total to complete the treatment according to generally accepted practices. In a like fashion, an article having a three inch minimum cross-section dimension would require a minimum of twelve hours total to complete the treatment according to the same accepted practices. However, it has been fairly conventional to increase the time periods for each step of the process to ensure that treatment is complete. Thus, for example, many of those practicing the above process routinely provide a safety factor of two or three or more in determining the respective time periods for the steps and as a consequence, overall treatment time periods of up to 50 hours or more for an article having a cross-sectional minimum dimension of one inch are often used. In using such extended time periods for the cryogenic treatment, it is believed that possible stress cracking and distortion of the article are thereby minimized or even eliminated. U.S. Pat. No. 5,259,200.

However, Kamody's personal inventive efforts are directed at reducing such process time.

> Generally, the commercial economics of metallurgical procedures dictate that a particular treatment should be accomplished as quickly as possible so as to minimize the size of the equipment necessary and thus equipment costs as well as requiring less space, energy and inventory in processing. Thus, for example, a tool steel article having a minimum cross-sectional dimension of about four inches, the maximum time for treatment [in accordance with Kamody's discovery] of the article in the bath of cryogenic fluid would be about ten minutes. U.S. Pat. No. 5,259,200.

Another format of a cryogenic process for extending the wear ability of a steel articles disclosed by U.S. Pat. No. 5,865,913—Paulin et al., for firearm barrels. This patent for treatment of firearm barrels can be taken as representative of various others still. In general, cryogenic process is popular for steel alloys because it improves the resistance of metal to normal wear and tear. It is speculated that cryogenic processes affect the wear ability of steel by four known mechanisms:—conversion of austenite to martensite; precipitation hardening which may increase Rockwell hardness; formation of fine carbide particles; and residual stress relief. Whether the mechanics are truly known, actual trials on numerous articles bears witness to cryogenics efficacy. Thus, in the case of firearm barrels, > . . . the accuracy of a firearm is directly tied to the heat generated by repeated firing and the wear of the firearm barrel as the firearm barrels heat up from repeated firing they will wander off axis due to residual stresses in the metal structure. This movement though ever so slight when measured at the muzzle becomes quite significant when measured at a target 200–300 yards away. In addition as the firearm barrels wear, their ability to maintain accuracy is severely diminished. Frequent replacement of conventional firearm barrels and components is necessary, particularly in bench rest shooting, varmint hunting, shooting teams, and the military. Firearm barrels and components treated with the controlled thermal profiling process of this invention have demonstrated that they have reduced residual stresses and increased wear resistance. This allows the firearm barrels and components to be fired with greater accuracy for longer periods of time. U.S. Pat. No. 5,865,913.

However, cryogenic process is laced with problems in aspects of how to best carry it out. For example, from the above-quoted patent on the firearms barrels—U.S. Pat. No. 5,865,913—it gave the warning that "sub-ambient treatments in the past utilized a liquid process which in some cases will cause thermal shock. This is detrimental as it will add stress to the structure." Id.

Accordingly, what is needed is an improvement as cryogenic process applied to dynamoelectric devices. A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

FIG. 3 is a table of findings for a given dynamoelectric device (ie., an AC motor) which was tested before and then again after being treated by the cryogenic tempering process in accordance with the invention;

FIGS. 4 through 7 comprise a series of comparable graphical representations of the findings listed in the FIG. 3 table, which profiles show the performance improvement achieved by the cryogenic treatment of the dynamoelectric device, wherein:

FIG. 4 provides a before and after Amps-RPM profile,

FIG. 5 provides a before and after Horsepower-RPM profile,

FIG. 6 provides a before and after efficiency-RPM profile, and

FIG. 7 provides a before and after motor torque-RPM profile.

DETAILED DESCRIPTION OF THE PREFERRED EMBODIMENTS

The cryogenic tempering process in accordance with the invention involves a controlled thermal profile (vis-a-vis ramp-down, hold, and ramp-up phases &c.) for treating the dynamoelectric devices. While the steps and values of the process, particularly as applied to the dynamoelectric devices, are unique, the deep cryogenic freeze equipment used in the process are known to those skilled in the art and will not be described in detail in the interests of clarity.

Electric motors are called dynamoelectric devices and are used in many applications to convert electrical energy to mechanical energy.

Figure 1:
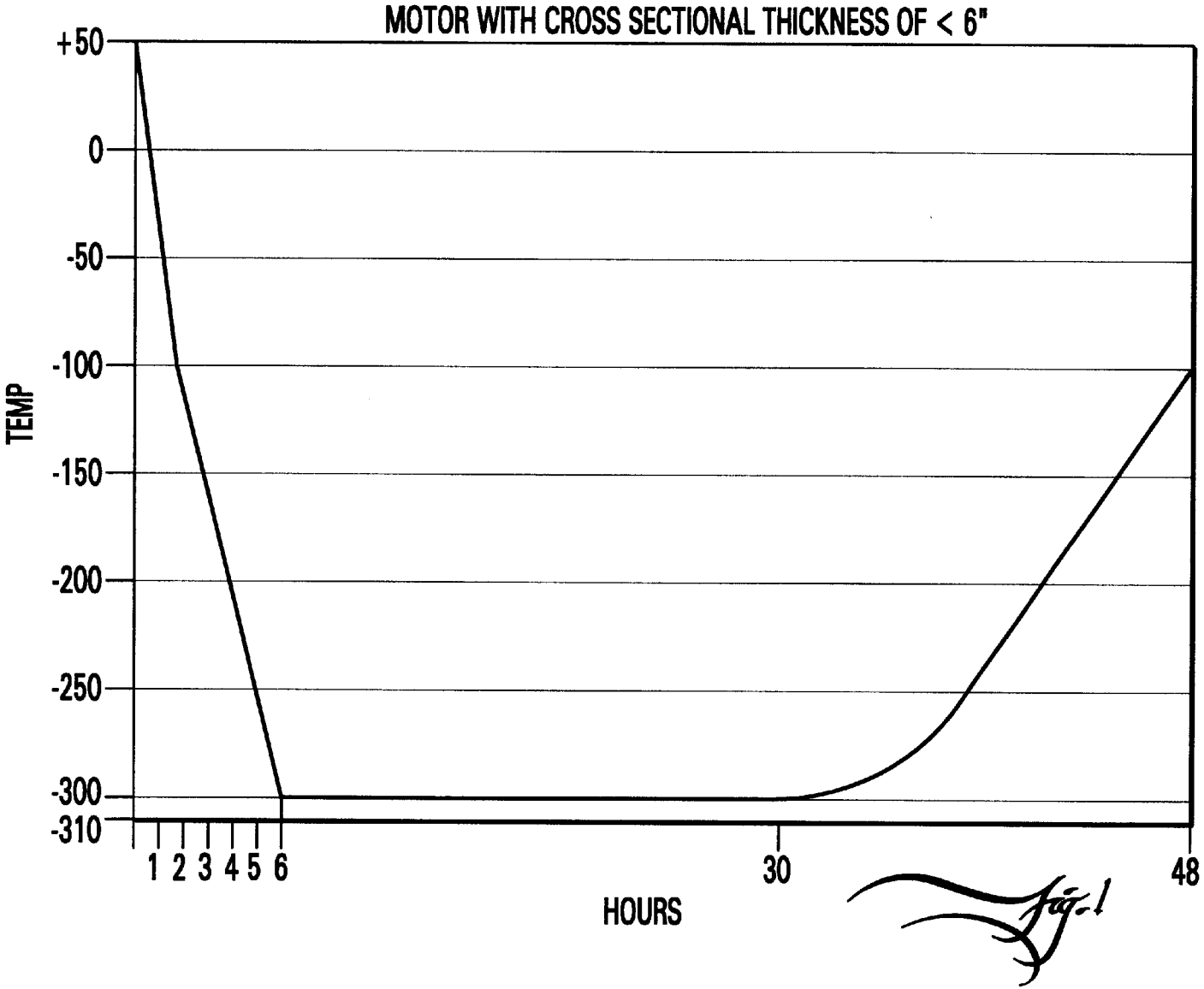
FIG. 1 is a graphical representation of a time-temperature profile for a cryogenic tempering process in accordance with the invention for treating dynamoelectric devices preferably having a cross-sectional measurement of less than 6 inches (15 cm)
Figure 2:
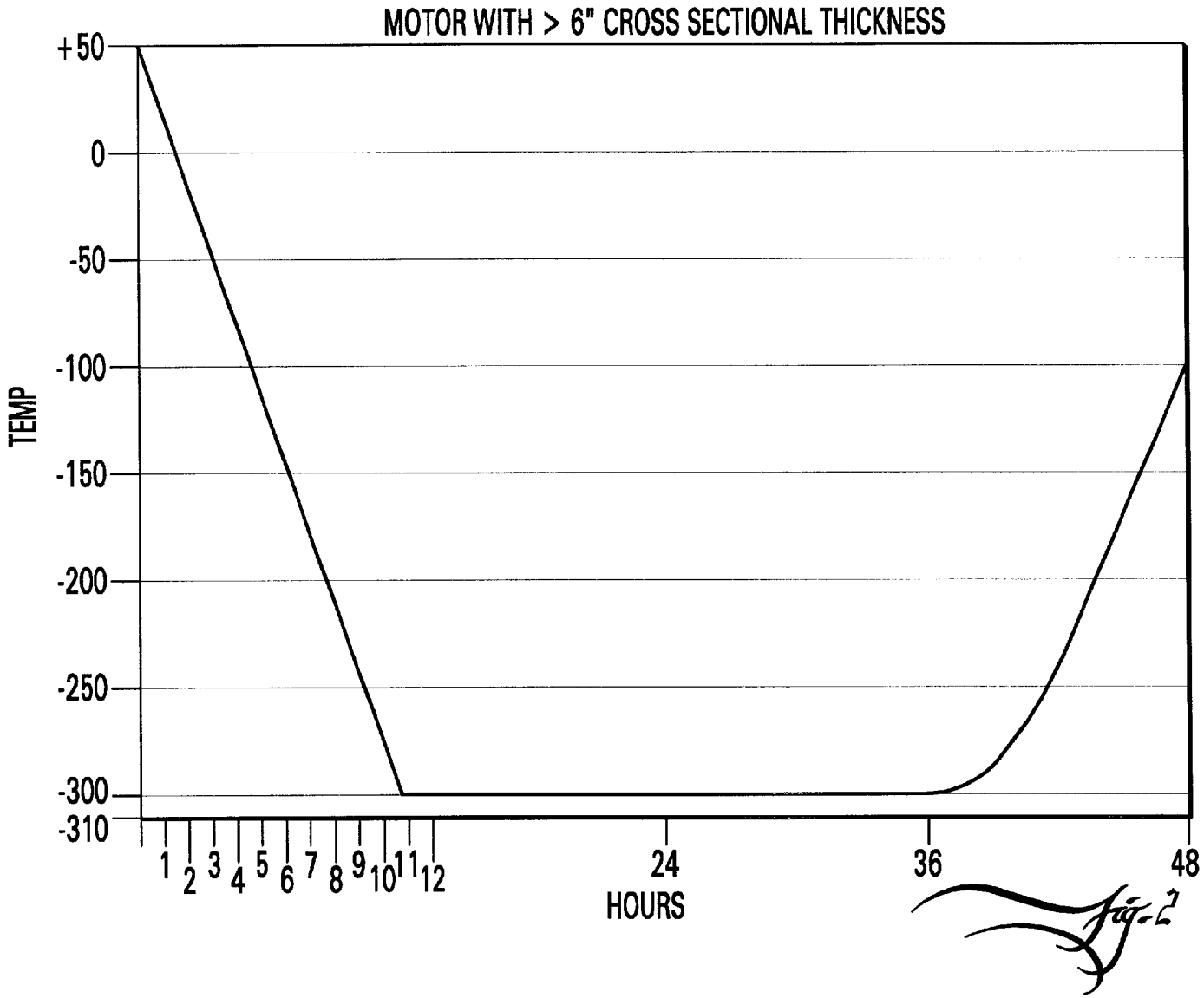
FIG. 2 is a graphical representation of a time-temperature profile for a cryogenic tempering process for treating dynamoelectric devices and comparable to FIG. 1 except preferably applicable to dynamoelectric devices having a cross-sectional measurement of greater than 6 inches (15 cm)

With reference to FIGS. 1 and 2, the cryogenic tempering process in accordance with the invention comprises a cryogenic cycle only. The cryogenic cycle of the process generally involves the gradual ramping down, holding, and then ramping up of the temperature of the dynamoelectric devices to cryogenic temperatures of −300° F. (−185° C.) or lower.

This cryogenic tempering process in accordance with the invention is accomplished with deep cryogenic freezing equipment. The electric motor are placed in a treatment chamber which is connected to a pressurized Dewar and metered feed-line and/or other supply of cryogenic fluid such as liquid nitrogen or the like. Liquid nitrogen is preferred. Exposure of the chamber of the cryogenic cooling system lowers the temperature of the dynamoelectric devices until the desired temperature or temperatures is/are achieved. Control devices of a common nature are employed to ensure that the cooling is gradual as desired. The cooling is intentionally very gradual to avoid stressing the payload in the chamber. As stated, the equipment relied on for carrying out the process in accordance with the invention is generally known to those skilled in the art and might not materially add to the novelty of the process. The tempering of the dynamoelectric devices can likewise be accomplished in any well-known conventional manner.

With renewed interest in the cryogenic cycle, FIGS. 1 and 2 show that the ramp-down phase is accomplished very gradually, and in accordance with a very specific set of parameters of temperature and time. At the frame of reference of initial time (or arbitrarily, time=zero), the dynamoelectric devices are resting at equilibrium in room temperature, or about 72° F. (22° C.). The following table correlates the target times and temperatures for the process in accordance with the system. By way of background, a control system is programmed with these parameters. Its temperature measurement for the system is taken from a sensor or probe in side cryogenic chamber. The rate at which the chamber is cooled varies depending on the cross sectional thickness of the items inside. The larger the cross sectional thickness the slower the descent.

FIG. 1 shows:

| Ramp down phase of Cryogenic cycle | | |
|---|---|---|
| Hour(s) after start | Temperature | Rate (° F./hrs) |
| 1 | −100° F. | 175~150 |
| 6 | −300° F. | 40 |

FIG. 2 shows:

| Ramp down phase of Cryogenic cycle | | |
|---|---|---|
| Hour(s) after start | Temperature | Rate (° F./hrs) |
| 12 | −300° F. | 29~31 |

In FIG. 2, the descent from the intermediate temperature of −100° F. to the bottom at −300° F. transpires preferably over about six to seven hours.

Following the ramp down phase is a "hold phase" in which dynamoelectric devices are exposed in the deep cryogenic temperatures for an extended period of time. The FIGURE shows that the duration of the preferred "hold phase" is preferably no less than about twenty-four (24), and more preferentially might be extended up to thirty-six (36) hours and more.

Some of the prior art cryogenic processes in accordance with the prior art literature call this a "soaking" phase, which is certainly technically correct in cases where the payload is immersed in liquid nitrogen. The process in accordance with invention utilizes a dry process. Here the payload is never immersed. Any boiling heat transfer environment which comes with immersion would be too damaging to the delicate dynamoelectric devices. The entire cryogenic cycle of the process in accordance with the invention can be characterized as "gentle":—gently down, gently hold and gently back up, especially very gently back up.

The liquid nitrogen is introduced into the chamber by means of a nozzle. In fact, in the preferred set up, the supply of the cryogenic fluid comprises a pressurized Dewar of liquid nitrogen. The feed nozzle for feeding the liquid nitrogen into the cryogenic chamber comprises a nozzle mounted in the chamber. The metering device comprises a processor-controlled solenoid valve in the feed line.

By the foregoing means the payload is held at about −300° F. for at least about twenty-four (24) hours and preferably about thirty-six (36) hours or longer. During this "hold phase" the metal certainly thermally contracts. It is assumed that the metal's microstructure reorganizes itself to become more spatially uniform. Regardless, field tests with the dynamoelectric devices after completion of the treatment prove that something advantageous happens to them.

Following the "hold phase," there is a correspondingly gradual "ramp up" phase. In FIG. 1, the cold of the chamber is allowed to decay in accordance at least originally with an exponential decay curve such that the temperature ramps up from −300° F. to −100° F. over about eighteen (18) hours. Again, the cryogenic tempering process as shown by FIG. 1 and in accordance with the invention is preferred for treating dynamoelectric devices having a cross-sectional measurement of less than 6 inches (15 cm). By a straight line method of reckoning the overall rate of ascent, the rate of ascent would measure as about 11° F. (eleven degrees F.) of warming each hour. However, as said, the temperature ascends at least originally in accordance with an exponential decay curve. The temperature of level of −200° F. is not reached from the base of −300° F. until eleven (11) hours into the start of the ramp up phase; the remaining warming up to −100° F. occurs over the next seven (7) hours, and at more or less a straight line ramp up at that. Hence, again by a straight line reckoning method, the warming rate for the first eleven (11) hours of the ramp up phase measures about 9° F. (nine degrees F) each hour.

It is during this portion of the ramp up phase which all thermal irregularities such as convection currents and the like, are more preferably eliminated than the majority of other times.

FIG. 2 shows a comparable trend except the ramp up phase is controlled to occur even at a relatively more rapid rate of ascent. The cryogenic tempering process as shown by FIG. 2 and in accordance with the invention is preferred for treating relatively larger dynamoelectric devices, for instance having a cross-sectional measurement of greater than 6 inches (15 cm). More particularly, FIG. 2 shows the cold of the chamber being allowed to decay in accordance at least originally with an exponential decay curve such that the temperature ramps up from −300° F. to −100° F. over about twelve (12) hours. By a straight line method of reckoning the rate of ascent, the rate of ascent would measure as 16⅔° F. (sixteen and ⅔ degrees F.) of warming each hour. However, as said, the temperature ascends at least originally in accordance with an exponential decay curve. The temperature of level of −200° F. is not reached from the base of −300° F. until eight (8) hours into the start of the ramp up phase; the remaining warming up to −100° F. occurs over the next four (4) hours, and at more or less a straight line ramp up at that. Hence, again by a straight line reckoning method, the warming rate for the first eight (8) hours of the ramp up phase measures about 12½° F. (twelve and ½ degrees F.) each hour.

Again, the temperature level of −100° F. marks the end of the ramp up phase for the cryogenic cycle.

To begin with, in the physical world, the payload of dynamoelectric devices is physically transferred out of the cryogenic chest to complete the process.

The process in accordance with the invention is complete. The dynamoelectric devices are ready for retrieval from the cryogenic processor and thereafter ready for the assembly process to have the shaft and grips assembled.

FIG. 3 provides in a table the findings of test results on a given dynamoelectric device (ie., an AC motor) which was tested both (i) before and then again (ii) after being treated by the cryogenic tempering process in accordance with the invention. FIGS. 4 through 7 comprise a series of comparable graphical representations of the findings listed in the FIG. 3 table. These FIGS. 4 through 7 comprise plotted profiles that show the performance improvement achieved by the cryogenic treatment of the dynamoelectric AC motor.

Figure 4:
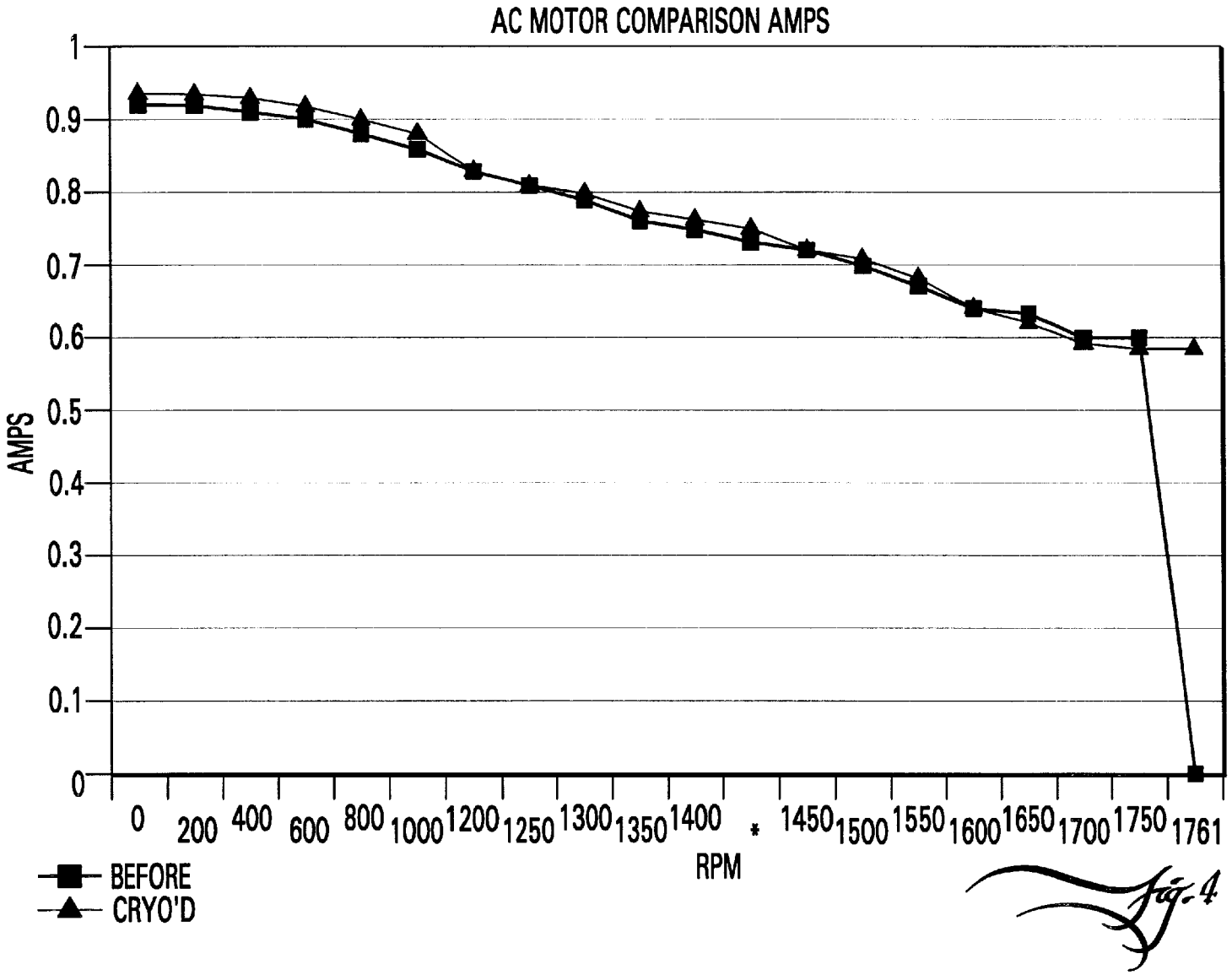

FIG. 4 provides before and after plotted profiles of Amps against RPM's. This shows that the cryogenic treatment of the AC motor gives it improved extended operability beyond its untreated current-saturation cut-off.

Figure 5:
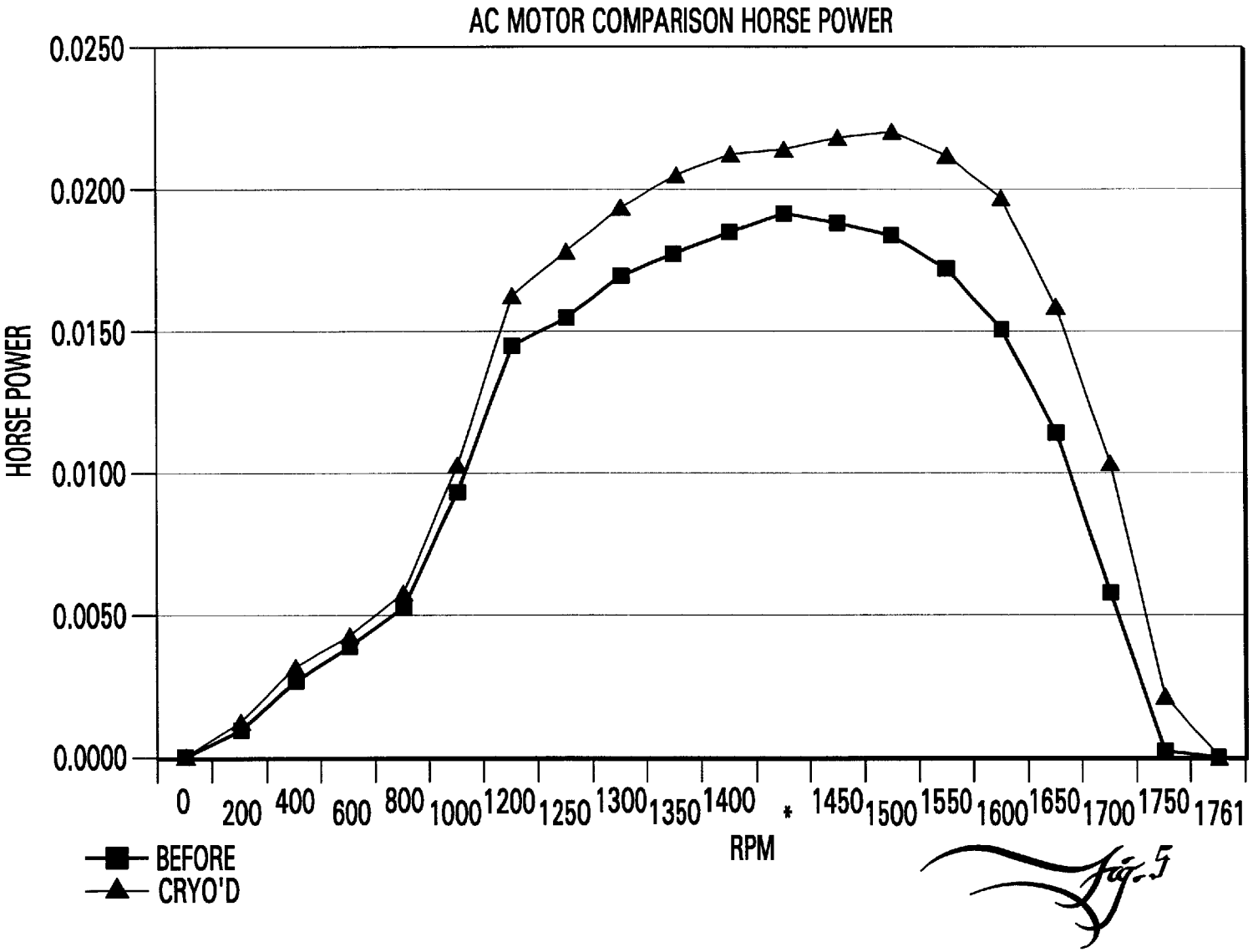

FIG. 5 provides before and after plotted profiles of Horsepower against RPM's. This shows that the cryogenic treatment of the AC motor gives it a boosted Horsepower output for the same operating speed.

Figure 6:
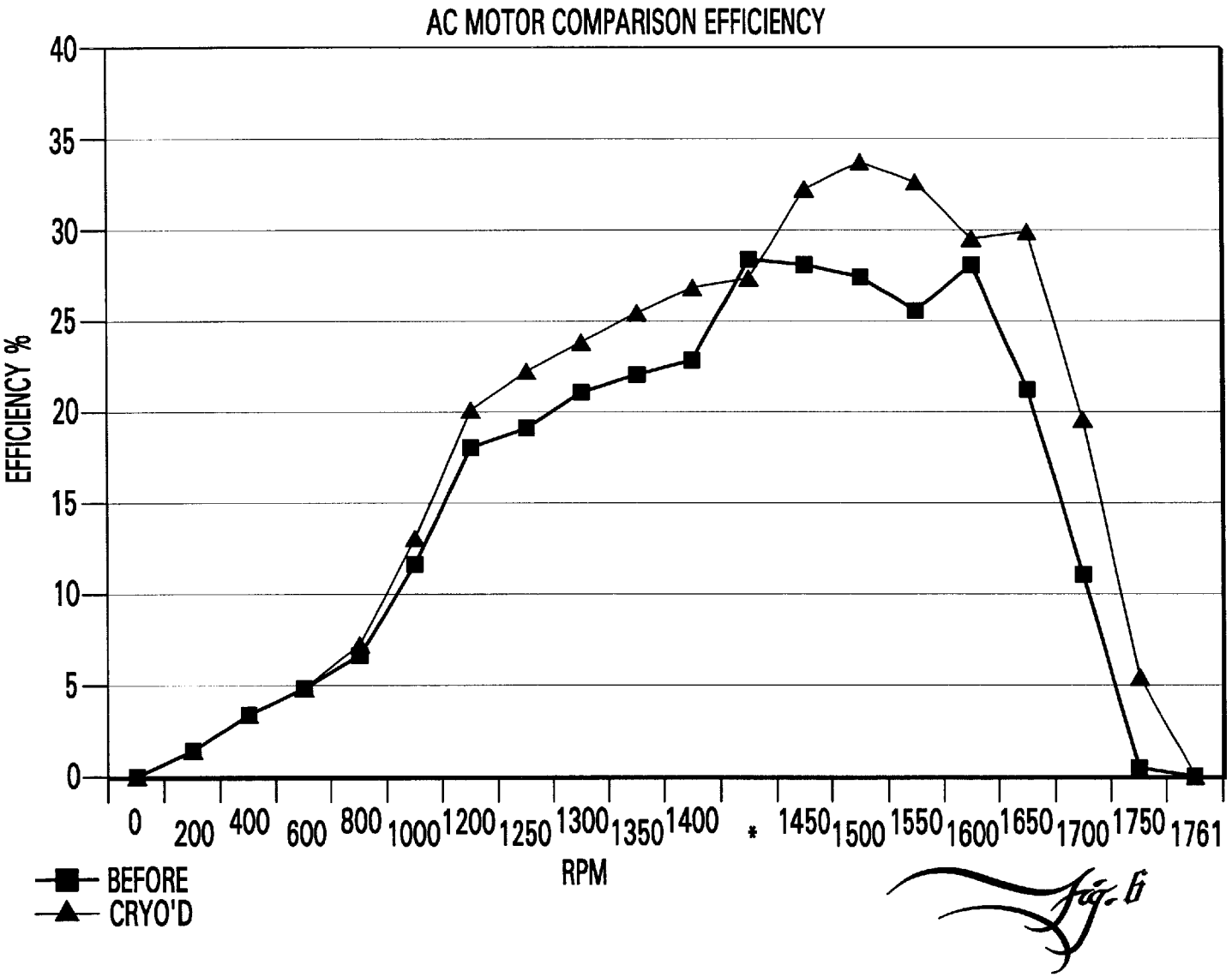

FIG. 6 provides before and after plotted profiles of efficiency against RPM's. This shows that the cryogenic treatment of the AC motor makes it more efficient.

Figure 7:
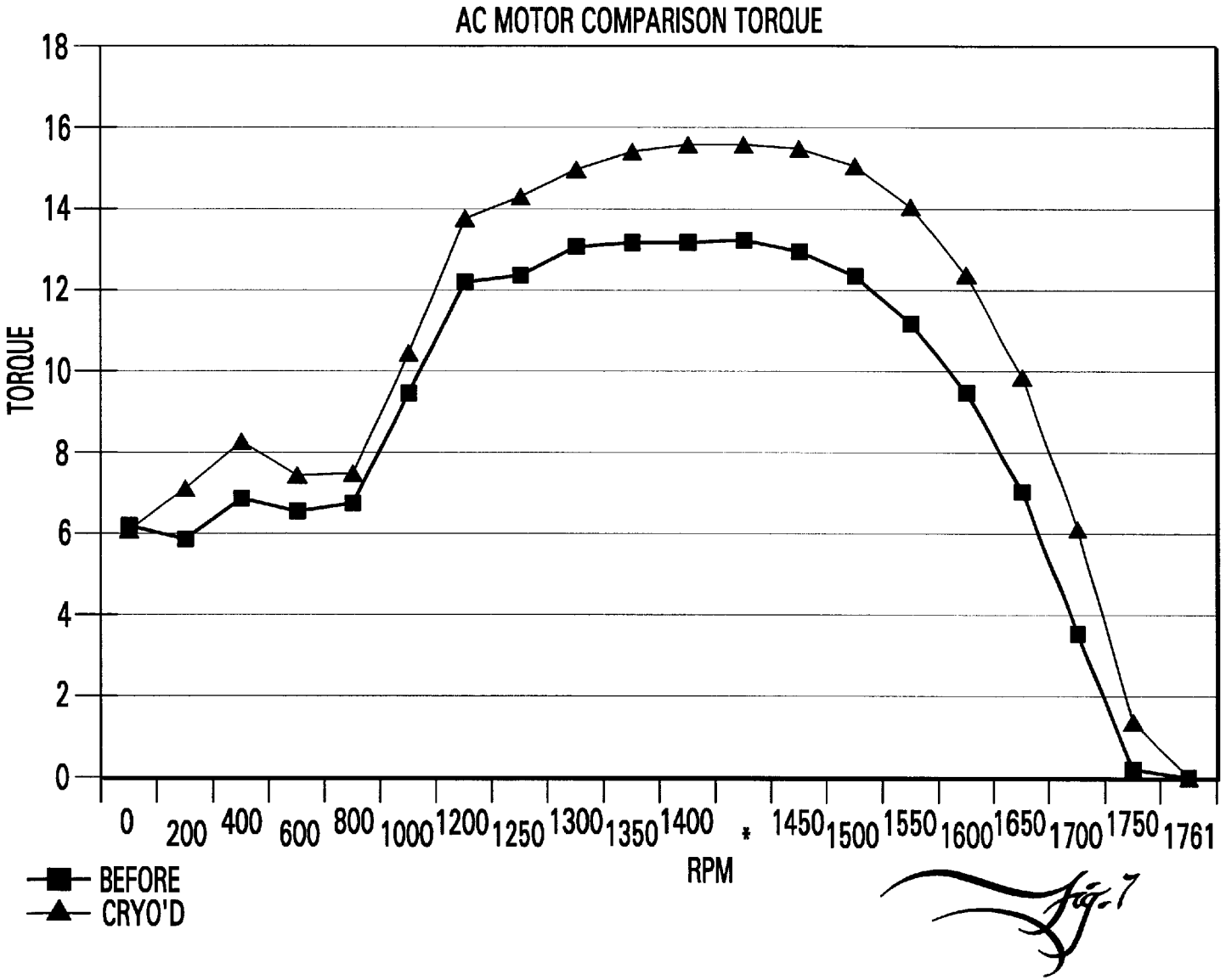

FIG. 7 provides before and after plotted profiles of motor torque against RPM's. This shows that the cryogenic treatment of the AC motor gives it a boosted torque product for the same operating speed.

The cost investment measured in terms of liquid nitrogen and electric power for the controller, averages out to a modest amount for each dynamoelectric devices. Certainly the cost of treatment is justifiable given the performance and durability improvements.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A cryogenic process for treating a conductor winding component of a dynamoelectric device comprising the steps of:

starting with the conductor winding component in an initial dry freezing starting environment of about minus 100° F.;

providing a cryogenic cycle having a ramp down phase during which from an initial start time the conductor winding component is ramped down in a dry cryogenic environment to about −300° F. over at least five (5) hours or more, followed by a cryogenic hold phase during which the conductor winding component is held at about −300° F. for longer than twenty-four (24) hours, followed by a cryogenic ramp up phase;

wherein the cryogenic ramp up phase has a varying rate of ascent that corresponds at least originally to an exponential decay of the cryogenic hold temperature from the about −300° F. to about −200° F. over at least eight (8) hours therefor.

2. The process of claim 1 wherein the temperature descent prior to said given start time, which takes the conductor winding component from an above freezing temperature to about −100° F., is achieved over at least one (1) hour prior to the given start time.

3. The process of claim 1 wherein the remaining exponential decay of the cryogenic intermediate temperature of about −200° F. occurs over at least a succeeding four (4) hours.

4. A conductor winding component for a dynamoelectric device comprising a copper winding component treated in accordance with the process of claim 1.

5. A conductor winding component for a dynamoelectric device comprising copper wire wound around an iron laminate treated in accordance with the process of claim 1.

6. A conductor winding component for an alternating current (AC) dynamoelectric device, a direct current (DC) dynamoelectric device, a brushless direct current (BLDC) dynamoelectric device, or split phase, shaded pole or brush type dynamoelectric devices treated in accordance with the process of claim 1.

7. A cryogenic process for treating a conductor winding component of a dynamoelectric device comprising the steps of:

starting with the conductor winding component in an initial dry freezing starting environment of about minus 100° F.;

providing a cryogenic cycle having a ramp down phase during which from an initial start time the conductor winding component is gradually ramped down in a dry cryogenic environment to about −300° F. over several hours, followed by a cryogenic hold phase during which the conductor winding component is held at about −300° F. for an additional several hours, followed by a cryogenic ramp up phase during which the conductor winding component is gradually ramped up to about −200° F. over another several hours;

wherein the cryogenic ramp up phase has a varying rate of ascent that corresponds at least originally to an exponential decay of the cryogenic hold temperature from the about −300° F. to about −200° F. over a major portion of the several other hours therefor.

8. The process of claim 7 wherein the temperature descent prior to said given start time, which takes the conductor winding component from an above freezing temperature to about −100° F., is achieved over at least one (1) hour prior to the given start time.

9. The process of claim 7 wherein the remaining ramp up from the cryogenic intermediate temperature of about −200° F. occurs over a remaining minor portion of the several other hours therefor.

10. A conductor winding component for a dynamoelectric device comprising a copper winding component treated in accordance with the process of claim 7.

11. A conductor winding component for a dynamoelectric device comprising copper wire wound around an iron laminate treated in accordance with the process of claim 7.

12. A conductor winding component for an alternating current (AC) dynamoelectric device, a direct current (DC) dynamoelectric device, a brushless direct current (BLDC) dynamoelectric device, or split phase, shaded pole or brush type dynamoelectric devices treated in accordance with the process of claim 7.

13. A cryogenic process for treating a conductor winding component of a dynamoelectric device comprising the steps of:

gradually ramping down the conductor winding component from at least an initial dry freezing starting environment of about minus 100° F. to a dry cryogenic holding temperature of about −300° F. over several hours and then holding the conductor winding component at the holding temperature for a holding phase lasting an additional several hours, after which the conductor winding component is gradually ramped up to about −100° F. over another several hours and according to a varying rate of ascent that at least originally corresponds to a more gradual rate of ascent from the cryogenic hold temperature of about −300° F. to about −200° F. over a major portion of said several other hours.

14. The process of claim 13 wherein the gradual ramp down occurs over at least five (5) hours.

15. The process of claim 13 wherein the holding phase occurs over at least twenty-four (24) hours.

16. The process of claim 13 wherein the gradual ramp up occurs over at least (8) hours.

17. A conductor winding component for a dynamoelectric device comprising a copper winding component treated in accordance with the process of claim 13.

18. A conductor winding component for an alternating current (AC) dynamoelectric device, a direct current (DC) dynamoelectric device, a brushless direct current (BLDC) dynamoelectric device, or split phase, shaded poled or brush type dynamoelectric devices treated in accordance with the process of claim 13.

* * * * *